US008181323B2

(12) United States Patent
Hailes

(10) Patent No.: US 8,181,323 B2
(45) Date of Patent: May 22, 2012

(54) ROMAN BLIND BATTEN GUIDE

(75) Inventor: Donald Craig Hailes, Seaford (AU)

(73) Assignee: SPP Industries Holdings Pty Ltd, Colmslie Queensland (AU)

( * ) Notice: Subject to any disclaimer, the term of this patent is extended or adjusted under 35 U.S.C. 154(b) by 177 days.

(21) Appl. No.: 12/438,013

(22) PCT Filed: Aug. 21, 2007

(86) PCT No.: PCT/AU2007/001199

§ 371 (c)(1),
(2), (4) Date: Feb. 19, 2009

(87) PCT Pub. No.: WO2008/022385

PCT Pub. Date: Feb. 28, 2008

(65) Prior Publication Data

US 2010/0163190 A1 Jul. 1, 2010

(30) Foreign Application Priority Data

Aug. 21, 2006 (AU) ..... 2006904526

(51) Int. Cl.
*B25B 27/20* (2006.01)

(52) U.S. Cl. ..... 29/243.56; 29/244; 29/270; 29/243.5

(58) Field of Classification Search ..... 29/243.56, 29/243.5–243.58, 255, 263, 280, 282
See application file for complete search history.

(56) References Cited

U.S. PATENT DOCUMENTS

| | | | | |
|---|---|---|---|---|
| 3,045,310 | A * | 7/1962 | Velinsky | 24/462 |
| 3,527,284 | A * | 9/1970 | Nelson et al. | 160/348 |
| 5,182,827 | A * | 2/1993 | Carrier et al. | 5/498 |
| 5,273,096 | A * | 12/1993 | Thomsen et al. | 160/84.01 |
| 5,310,527 | A * | 5/1994 | Romanauskas et al. | 422/102 |
| 5,666,709 | A * | 9/1997 | Suzuki | 29/243.56 |
| 6,257,300 | B1 * | 7/2001 | Brownlie | 160/84.01 |
| 6,494,339 | B1 * | 12/2002 | Engelhard et al. | 220/475 |
| 2010/0163190 | A1 * | 7/2010 | Hailes | 160/84.04 |

FOREIGN PATENT DOCUMENTS

| | | |
|---|---|---|
| GB | 2 246 593 | 7/1991 |
| WO | 2005/044064 | 5/2005 |

OTHER PUBLICATIONS

International Search Report and Written Opinion.

* cited by examiner

*Primary Examiner* — Lee D Wilson
(74) *Attorney, Agent, or Firm* — Renner, Otto, Boisselle & Sklar, LLP

(57) ABSTRACT

A guide (2) for inserting a fold of fabric into the batten of a Roman blind comprising a leading end (12) and a trailing end (4). A slot (10) runs from trailing end (12) to leading end (4). The slot (10) has a T-section which opens into a countersunk central area (14) towards the leading end (12) and into a bore (6) towards the trailing end (4). The bore (6) is adapted to receive a leading end of the batten (8) and a screw (18) projects from the sidewall into the bore (6) in order to engage the batten (8).

10 Claims, 3 Drawing Sheets

ROMAN BLIND BATTEN GUIDE

This application is a national phase of International Application No. PCT/AU2007/001199 filed Aug. 21, 2007 and published in the English language.

FIELD OF THE INVENTION

This invention concerns a method of making a Roman blind and apparatus for facilitating the manufacture of such blinds.

BACKGROUND OF THE INVENTION

Roman blinds rely on the use of battens which extend from selvedge to selvedge in the blind fabric. Each batten has a series of eyes through which vertical control lines pass and these lines cause rise and fall in the blind. The battens are commonly aluminium extrusions and these attach to the fabric. One type of blind construction is described in our co-pending patent application no. 2006903061.

The extrusion in that specification had a pair of sidewalls which defined a fabric slot. The assembled blind housed a 2-3 mm diameter plastic rod which imprisoned a loop of fabric in the slot. End caps confined the rod and stabilised the structure. The extrusions are powdercoated and cut from stock lengths by a parting tool. This leaves the ends with sharp edges. During the assembly process the fabric is creased to create a loop of double thickness and the extrusion is slid across the fabric so that the crease enters the fabric slot. The sharp ends abrade the fabric and damage occurs unless the assembly is slow and careful. Consequently assembly is slow even with experienced assemblers.

SUMMARY OF THE INVENTION

The method aspect of the invention provides a method of inserting a fold of fabric into the fabric slot of the batten of a Roman blind comprising, folding the fabric, seating a slotted guide on the leading end of the batten and offering the entrance of the slotted guide to the edge of the fabric fold and advancing the guide and batten together across the width of the fabric in order to progressively feed the fold into the fabric slot of the batten until the batten spans the width of the fabric.

Once the entire width of the fabric engages the batten, the guide is removed and used for a subsequent batten. End caps may be fitted on the ends of the batten once the guide is removed.

Preferably a rod is placed at the site of the fold and both rod and fabric are offered to the entrance of the guide.

The advance of the guide imprisons the rod and fabric in the fabric slot of the batten.

When no rod is present the fabric may be retained in the fabric slot by subjecting the extrusion to a crimping action to converge the sidewalls of the batten and nip the fabric. When the assembly includes a rod, the procedure entails forming a fabric fold into a keyhole shape around the rod using a guide before it is presented to the leading end of the extrusion.

The apparatus aspect of the invention provides a device for inserting a fold of fabric into the batten of a Roman blind comprising a sleeve with a leading end and a trailing end, a guide slot of substantially keyhole section extending axially from end to end.

Preferably the guide has means for aligning the slot with the fabric slot of a blind batten.

Preferably the leading end of the guide slot is chamfered or otherwise relieved to impose a keyhole conformation on the folded fabric.

Preferably the means for aligning the slot is a cavity in the trailing end of the sleeve and a spline or keyway projecting from the sleeve into the cavity. The spline or keyway may be adapted to engage with the batten. In a particular aspect the spline or keyway may be adapted to engage with a clip slot of the batten, which clip slot lies alongside the fabric slot. Engagement between the keyway and the clip slot ensures the guide slot registers with the fabric slot in the batten.

The sleeve may be machined from plastic rod or moulded. Likewise the device may be turned from timber dowel, die cast or machined from metal rod.

BRIEF DESCRIPTION OF THE DRAWINGS

In the specification the fabric, extrusions, clips and lines are as described in our co-pending patent application no. 2006903061.

One embodiment of the invention is now described with reference to the accompanying drawings, in which.

DETAILED DESCRIPTION WITH RESPECT TO THE DRAWINGS

Figure 1:
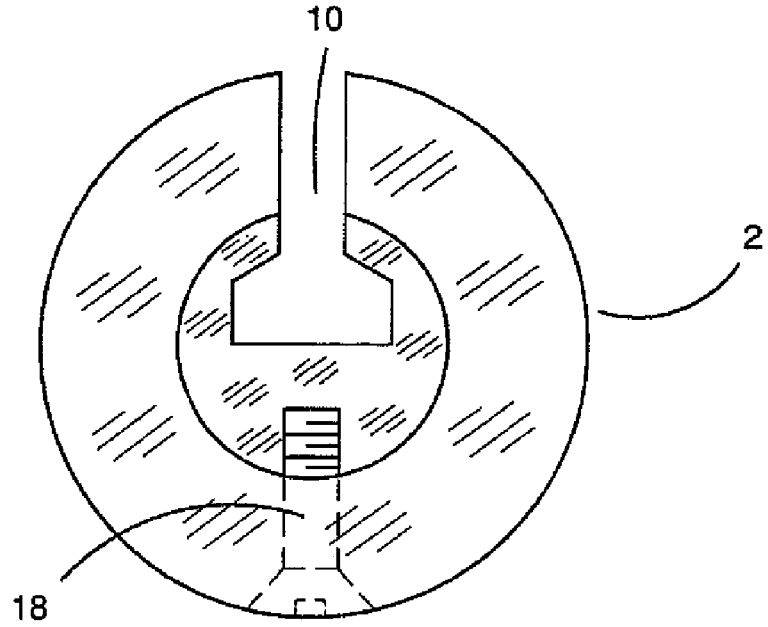
FIG. 1 is an end view of the trailing end of the guide.
Figure 2:
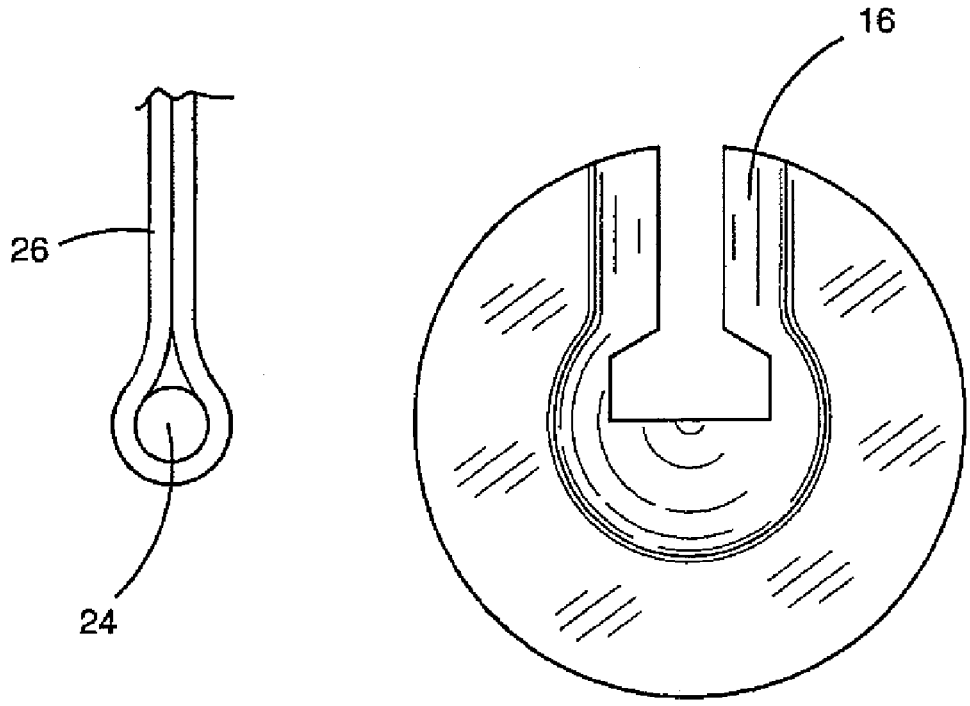
FIG. 2 is an end view of both the leading end and a loop of blend fabric enclosing a retaining rod.
Figure 3:
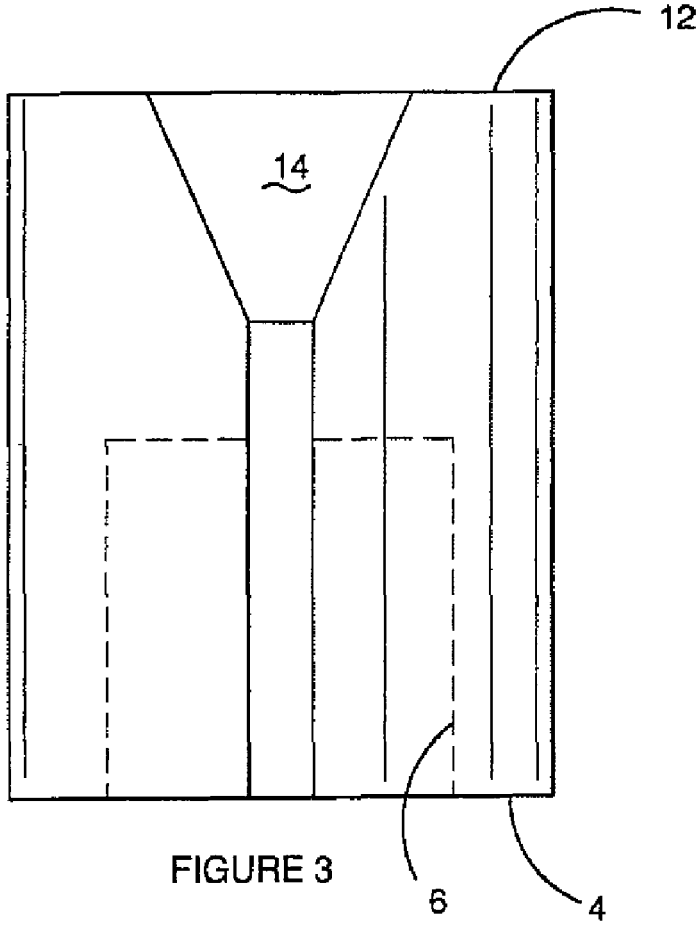
FIG. 3 is a plan view of the guide.
Figure 4:
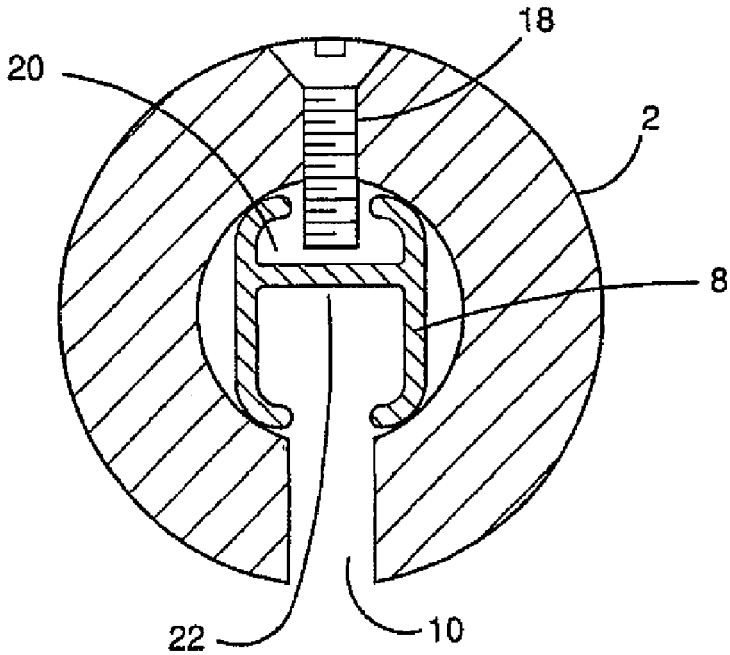
FIG. 4 is an end sectional view of the extrusion inserted into the trailing end of the guide.

Referring now to FIGS. 1-4, the guide 2 is made from polyethylene rod 20 mm in diameter and 30 mm in length.

The trailing end 4 has a bore 6, 15 mm deep and 11 mm in diameter. The bore 6 is intended to receive the leading end of extrusion 8. A slot 10 runs axially from the trailing end 4 to the leading end 12. The slot has a T-section which, toward the leading end, opens into a countersunk central area 14 and the radial part 16 of the slot diverges. The sidewall of the bore 4 is drilled and threaded to support a screw 18 which projects into the clip slot 20 preventing rotation of the sleeve on the extrusion and ensuring that fabric slot 22 is always in register with the sleeve slot 10.

Figure 5:
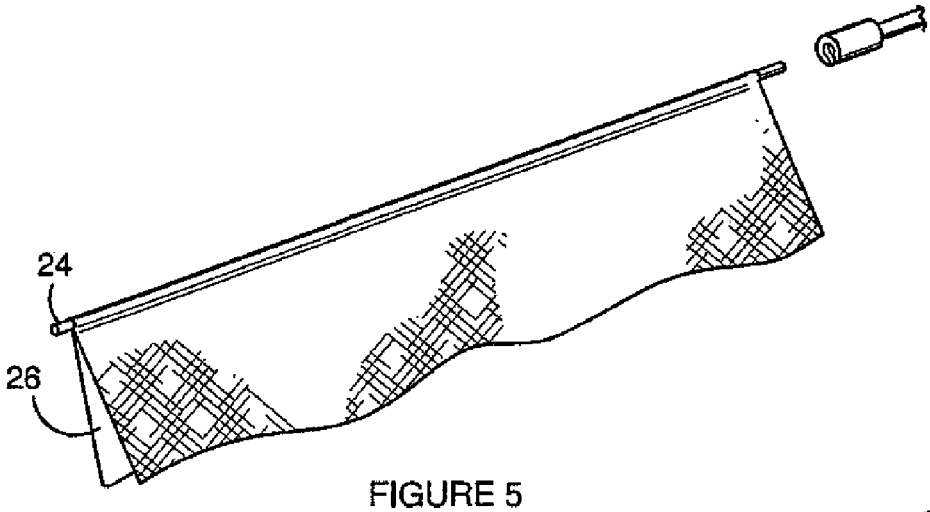
FIG. 5 is a perspective view of a rod lying beneath the crease in a loop of fabric ready to receive the guide.
Figure 6:
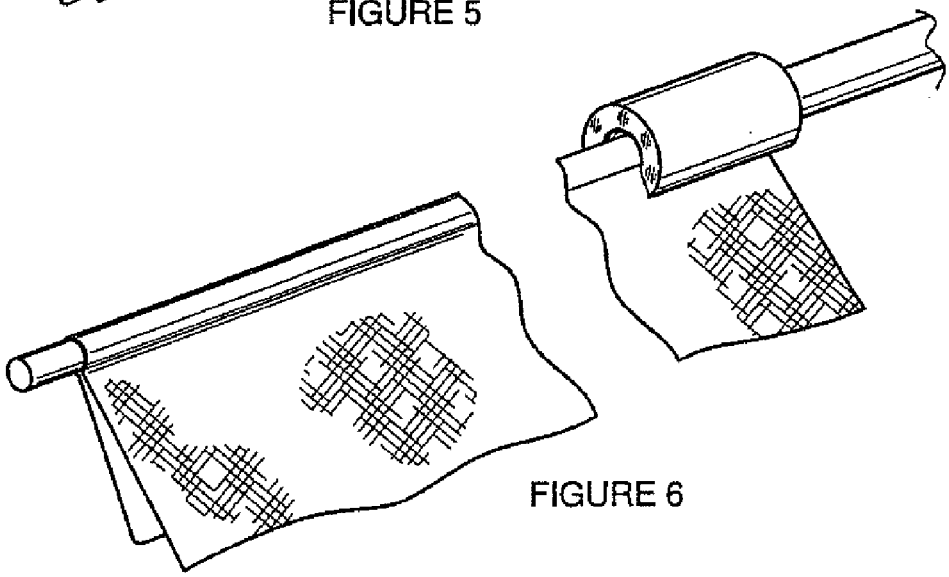
FIG. 6 is an enlarged perspective of the guide engaging the rod and fabric of FIG. 5.
Figure 7:
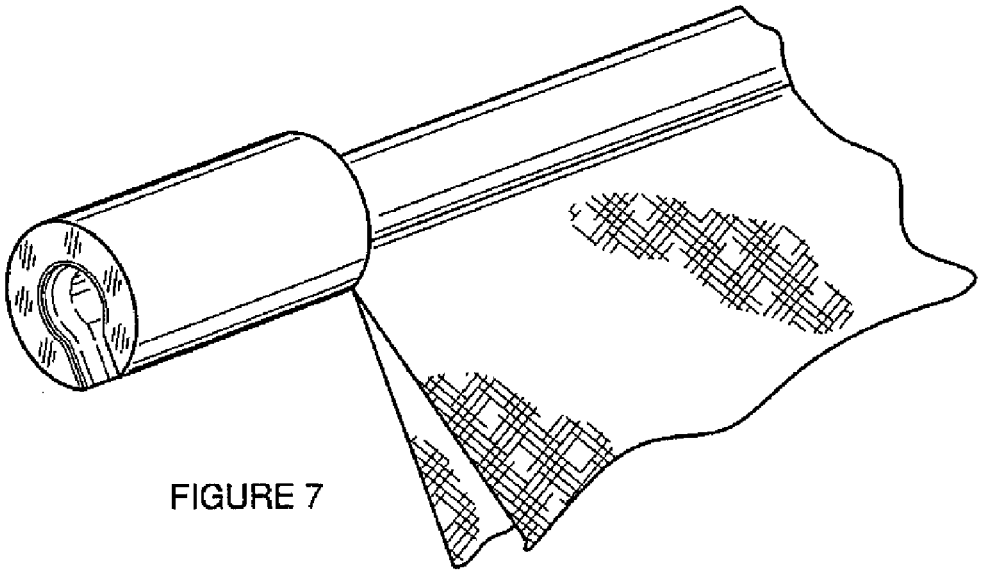
FIG. 7 is an enlarged perspective view of the extrusion extending across the whole width of the fabric with the guide ready to be removed.

Referring now to FIG. 5, prior to assembly the fabric is creased along fold lines perpendicular to the selvedge.

A 3 mm polyethylene rod 24 a few millimeters longer than the fabric width is inserted between the looped fabric 26.

One end of the extrusion 8 is offered up to the bore of the sleeve guide so that screw 18 enters the clip slot 20. The extrusion is pushed 15 mm into the bore.

The leading end of the guide 2 is offered up to the rod 24 so that the rod enters the countersunk area and then the slot. At the same time the fingers of the user's remaining hand pinch the fabric around the rod and feed the rod and fabric into a keyhole shape. Once the entry has been made, the fabric can be held with one hand while the other hand pushes the extrusion together with the guide sleeve across the width of the fabric.

The sharp end edge of the extrusion never contacts the fabric. Once the extrusion spans the fabric, the guide sleeve is removed. The rod is now imprisoned in the fabric slot and cannot be pulled out of the extrusion. End caps (not shown) are pushed on and the blind is ready for the next batten.

We have found the advantages of the above embodiment to be:

1. Assembly time is reduced substantially.
2. Damage to the fabric is prevented.

The invention claimed is:

1. A device for inserting a fold of fabric into a batten of a Roman blind comprising, a sleeve with a leading end and a trailing end, the trailing end of the sleeve being shaped to receive the batten of the Roman blind, and said sleeve comprising a guide slot of substantially keyhole section extending axially from said trailing end to said leading end, said guide slot having a trailing bore portion for receiving the batten, the trailing bore portion terminating at a smaller width portion of the guide slot, and said guide slot having a diverging portion that extends axially from the smaller width portion towards said leading end of the sleeve and diverges outwardly to receive said fold of fabric.

2. The device according to claim 1 comprising means for aligning the guide slot with a fabric receiving slot of the batten.

3. The device according to claim 2 wherein the means for aligning the guide slot is a cavity in the trailing end of the sleeve and a spline or keyway projecting from the sleeve into the cavity, the spline or keyway being adapted to engage the batten.

4. The device according to claim 1 wherein the leading end of the guide slot is chamfered or otherwise relieved to impose a keyhole conformation on the folded fabric.

5. The device according to claim 1 wherein the device is machined from plastic rod or moulded from plastic.

6. A method of inserting a fold of fabric into the fabric slot of the batten of a Roman blind using the device of claim 1, the method comprising, folding the fabric; seating the device on the leading end of the batten, offering the diverging portion of the guide slot at the leading end of the device to the edge of the fabric fold, and advancing the device and batten together across the width of the fabric in order to progressively feed the fold into the fabric slot of the batten until the batten spans the width of the fabric.

7. The method according to claim 6 wherein, once the entire width of fabric engages the batten, the device is removed and end caps are fitted on the batten.

8. The method according to claim 6 comprising, placing a rod at the site of the fold, offering both rod and fabric to the entrance of the device, and advancing the device and batten together along both rod and fabric in order to imprison both rod and fabric in the fabric slot of the batten.

9. The method according to claim 8 wherein the fabric is folded into a keyhole shape around the rod before both rod and fabric are offered to the diverging portion of the guide slot at the leading end of the device.

10. The method according to claim 6 wherein the fabric is retained in the fabric slot by subjecting the batten to a crimping action to converge the sidewalls of the batten and nip the fabric.

* * * * *